US010479576B2

(12) United States Patent
Li et al.

(10) Patent No.: US 10,479,576 B2
(45) Date of Patent: Nov. 19, 2019

(54) RECLOSEABLE PACKAGE, RECLOSEABLE PACKAGING METHOD, AND METHOD OF USING RECLOSEABLE PACKAGE

(71) Applicant: Inteplast Group Corporation, Livingston, NJ (US)

(72) Inventors: Ting Li, Port Lavaca, TX (US); Andy Lu, Victoria, TX (US); Ter-Hai Lin, Sugar Land, TX (US); Jeff Teng, Sugar Land, TX (US)

(73) Assignee: Inteplast Group Corporation, Livingston, NJ (US)

( * ) Notice: Subject to any disclaimer, the term of this patent is extended or adjusted under 35 U.S.C. 154(b) by 358 days.

(21) Appl. No.: 15/276,330

(22) Filed: Sep. 26, 2016

(65) Prior Publication Data

US 2017/0088323 A1 Mar. 30, 2017

Related U.S. Application Data

(60) Provisional application No. 62/232,189, filed on Sep. 24, 2015.

(51) Int. Cl.
*B65D 65/14* (2006.01)
*B65D 81/24* (2006.01)

(52) U.S. Cl.
CPC ..... *B65D 65/14* (2013.01); *B65D 81/245* (2013.01)

(58) Field of Classification Search
CPC ..... B65D 65/14; B65D 81/245
USPC ..... 206/484
See application file for complete search history.

(56) References Cited

U.S. PATENT DOCUMENTS

| | | | | |
|---|---|---|---|---|
| 3,355,857 | A | 12/1967 | Tobey | |
| 3,490,353 | A | 1/1970 | Madonia | |
| 5,662,758 | A | 9/1997 | Hamilton et al. | |
| 5,691,052 | A * | 11/1997 | Jones | B32B 27/08 428/355 EN |
| 5,955,205 | A | 9/1999 | Ramsey et al. | |
| 6,299,966 | B1 * | 10/2001 | Bonke | B32B 3/26 428/173 |
| 6,489,022 | B1 | 12/2002 | Hamilton et al. | |
| 6,737,130 | B2 | 5/2004 | Ferri | |

OTHER PUBLICATIONS

LeMatic Bulk Packer LS132 product sheet, www.lematic.com, 2 pages, published prior to Sep. 24, 2015.
Photograph entitled "Buns in Storage" admitted prior art.
Photograph entitled "Buns on Rack" admitted prior art.
Photograph entitled "Buns on Trays" admitted prior art.

* cited by examiner

*Primary Examiner* — Steven A. Reynolds
*Assistant Examiner* — Javier A Pagan
(74) *Attorney, Agent, or Firm* — Stinson LLP

(57) ABSTRACT

A package for storing perishable goods. Film forming the package has an inner layer that defines an interior surface of the package and is formed from a polyethylene and a tack agent that has migrated to the interior surface to provide tackiness. The tackiness permits cold resealing of the package after it has been opened, without substantially adhering to the perishable goods so that the perishable goods can be non-destructively removed from the package. An outer layer of the film defines an exterior surface of the package and is formed from another polyethylene. The polyethylene of the outer layer is configured to block migration of the tack agent through the outer layer such that the exterior surface is substantially non-tacky.

25 Claims, 8 Drawing Sheets

RECLOSEABLE PACKAGE, RECLOSEABLE PACKAGING METHOD, AND METHOD OF USING RECLOSEABLE PACKAGE

CROSS REFERENCE TO RELATED APPLICATION

This application claims priority to U.S. Provisional Patent Application No. 62/232,189, filed Sep. 24, 2015.

FIELD

The disclosure generally relates to reclosable packaging and the use of such packages and more specifically to passively reclosable packaging from cold sealable film.

BACKGROUND

In the food industry, perishable goods, such as baked goods like hamburger buns, are packaged in air-tight containers to maintain freshness. Once the packages are opened, however, the perishable goods are exposed to environmental conditions that can cause loss of freshness. In, for example, the fast food industry, food is consumed at a much higher rate during peak hours than during non-peak hours. Oftentimes, multiple packages of the same food item will be opened during peak hours to meet demand, which causes more product to lose freshness during non-peak hours. One approach to minimizing the loss of freshness after opening is to use a reclosable package. But conventional reclosable packages such as zippered bags can be expensive to manufacture relative to more simply constructed packages. Another alternative is reusable lidded containers, but these require washing after each use. However, lidded bags and zippered containers take time to close, which may not be practical in a commercial kitchen environment.

SUMMARY

In one aspect, a package for storing perishable goods comprises first and second film sheets having respective interior and exterior surfaces and perimeter edge margins. The first and second sheets are sealed together along the perimeter edge margins such that the interior surfaces of the sheets define an interior of the package for receiving the perishable goods. The package is selectively openable by forming an opening in the first and second sheets, and at least the first sheet has an inner layer defining the interior surface of the first sheet and comprising a polyethylene and a tack agent. At least some of the tack agent has migrated through the polyethylene to the interior surface of the first sheet to provide tackiness to the interior surface of the first sheet configured to reseal the package when pressed against the interior surface of the second sheet after being opened. And the tackiness is configured to limit adhesion between the interior surface of the first sheet and said perishable goods such that the perishable goods in direct contact with the interior surface of the first sheet can be non-destructively separated therefrom and withdrawn from the package when the package is open.

In another aspect, a package for storing perishable goods comprises first and second film sheets having respective interior and exterior surfaces and perimeter edge margins. The first and second sheets are sealed together along the perimeter edge margins such that the interior surfaces of the sheets define an interior of the package for receiving the perishable goods. The package is selectively openable by forming an opening in the first and second sheets. At least the first sheet has an inner layer defining the interior surface of the first sheet and comprising a first polyethylene and a tack agent and an outer layer defining the exterior surface of the first sheet and comprising a second polyethylene. The first polyethylene being configured to permit migration of the tack agent to the interior surface of the first sheet to provide tackiness to the interior surface of the first sheet configured for adhesively resealing the interior surface of the first sheet with the second sheet after the package has been opened. The second polyethylene is configured to block migration of the tack agent through the outer layer to the exterior surface of the first sheet such that the exterior surface of the first sheet is substantially non-tacky.

Other aspects and features will be apparent and/or pointed out hereinafter.

BRIEF DESCRIPTION OF THE DRAWINGS

Corresponding reference characters indicate corresponding parts throughout the drawings.

DETAILED DESCRIPTION

Figure 1:
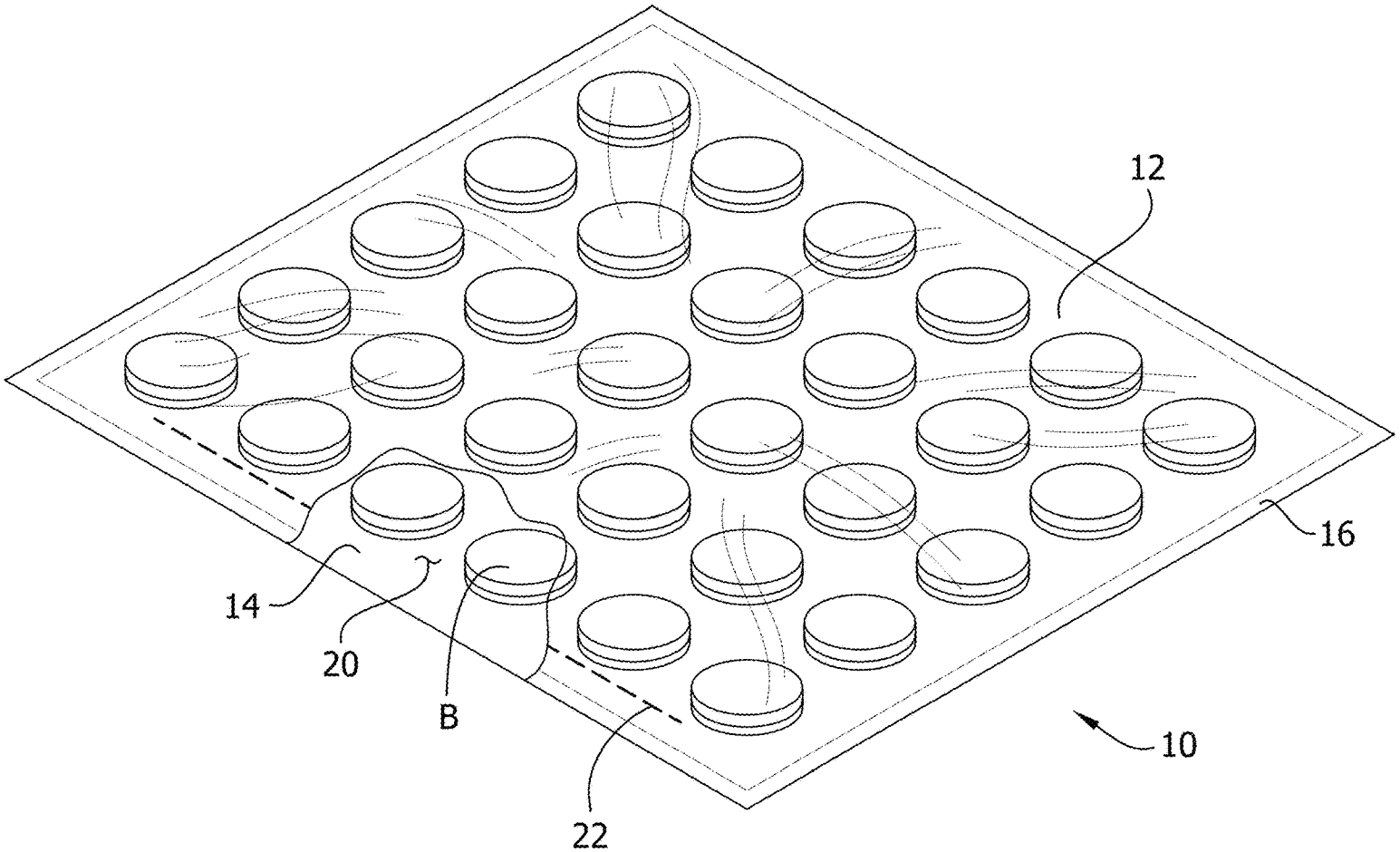
FIG. 1 is a fragmentary perspective of a package of hamburger buns partially broken away to show internal features.

Referring to FIG. 1, a package of hamburger buns B is generally indicated at reference number 10. As will be appreciated the package 10 is a selectively openable and reclosable package that can be manufactured relatively inexpensively using conventional packaging equipment to maintain the freshness of the hamburger buns B long after the package is initially opened. Although the illustrated package 10 encloses hamburger buns B, it will be understood that other packages can enclose other perishable goods or other items without departing from the scope of the invention.

The illustrated package 10 includes a top film sheet 12 and a bottom film sheet 14 (broadly, first and second film sheets). The top and bottom film sheets 12, 14 each have a respective interior surface, exterior surface, and perimeter edge margin. The film sheets are oriented so the interior surface of the top sheet 12 faces downward and opposes the upwardly facing interior surface of the bottom sheet 14. The perimeter edge margin of the top film sheet 12 is suitably attached—such as by heat sealing—to the perimeter edge margin of the bottom film sheet 14 to form the sealed perimeter edge margin 16 of the package 10. The sealed perimeter edge margin 16 and the interior surfaces of the top and bottom film sheets 12, 14 define an interior 20 of the package 10. The hamburger buns B are received in the interior 20 of the package 10 between the top and bottom film sheets 12, 14. The illustrated package 10 encloses thirty hamburger buns B, but other packages can enclose other numbers without departing from the scope of the invention.

The package 10 can be opened by tearing either or both of the top and bottom film sheets 12, 14. In the illustrated embodiment, the top film sheet 12 comprises a zone of weakness that forms a tear line 22 for opening the package 10. Preferably, the tear line 22 is non-perforated so that the interior 20 of the package 10 remains fluidly isolated from the external environment prior to opening. In contrast to perforated tear lines, which allow fluid communication between a package's interior and the environment, the non-perforated tear line 22 fluidly isolates the package interior 20 from its environment and can increase the length of time the buns B remain fresh in the package 10 before opening. In one or more embodiments, the top film sheet 12 is embossed or scored in a non-perforated manner to form the tear line 22. The top sheet 12 may be marked with a printed indication of the location of the tear line 22 to aid the user in identifying where to tear open the package 10. The tear line 22 is preferably positioned so that, after the package 10 is opened by tearing the top sheet 12 along the tear line, the interior surface of the top sheet can, as discussed in further detail below, be pressed against the interior surface of the bottom sheet 14 to reseal and reclose the package. In one or more embodiments, the tear line 22 is oriented in the machine direction of the respective film sheet 12, 14.

Figure 2:
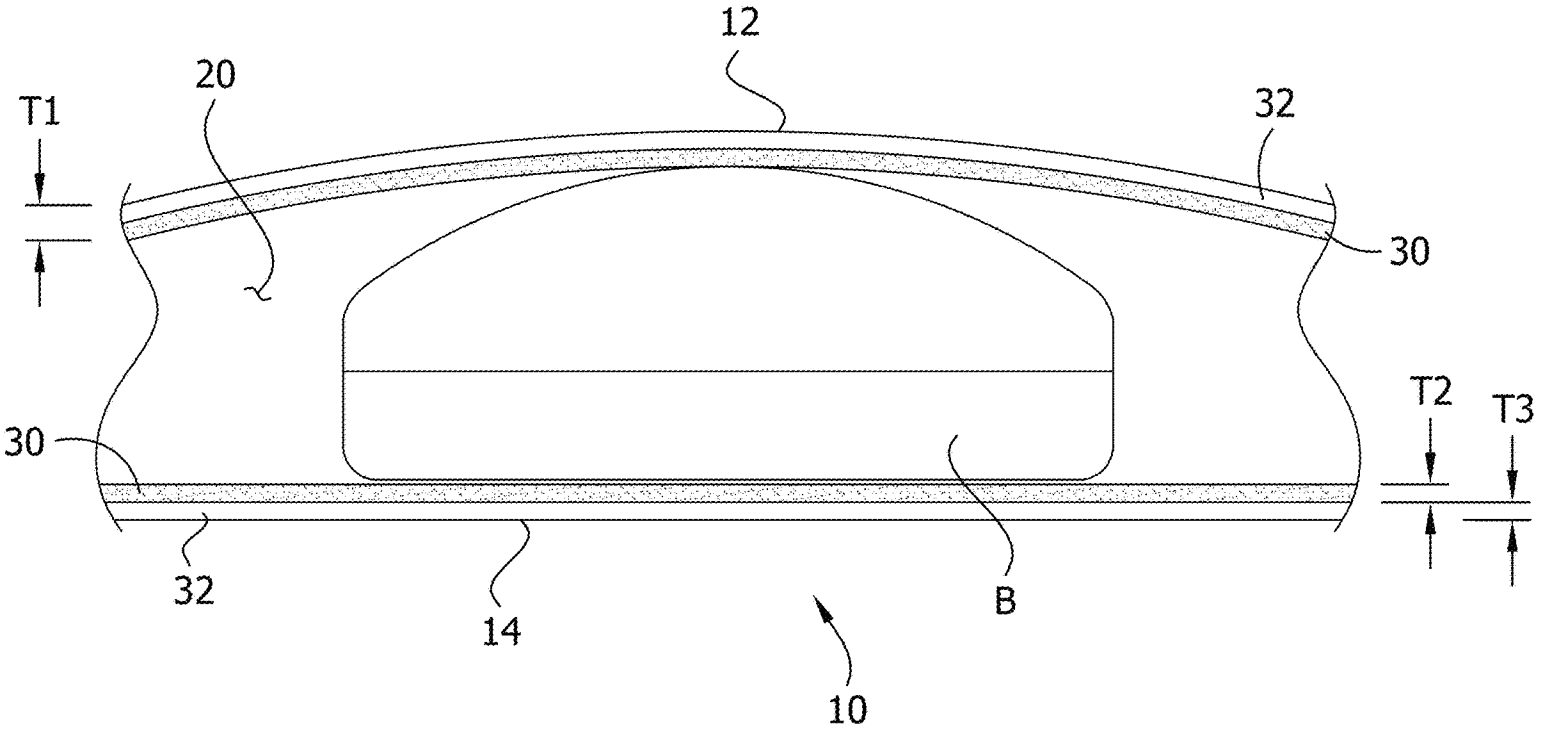
FIG. 2 is a fragmentary cross section of the package.

Referring to FIG. 2, the top and bottom sheets 12, 14 of the package 10 are formed from partly tacky film to enable resealing of the package after it has been opened, such as by tearing the upper sheet 12 along the tear line 22. In the illustrated embodiment, each of the top and bottom sheets 12, 14 is a two-layer film. An inner layer 30, which defines the interior surface of the respective sheet 12, 14, comprises a tacky material, and an outer layer 32, which defines the exterior surface of the respective sheet 12, 14, is formed from a non-tacky material. The inner layers 30 and outer layers 32 are laminated together to form the respective sheets 12, 14.

The tacky material of the inner layers 30 is configured for forming a cold seal of the package 10 after the package has been opened. For example, in the illustrated embodiment, after the top sheet 12 is torn along the tear line 22, the top sheet can be pressed into contact with the bottom sheet 14, whereby the tackiness of the interior surfaces of the top and bottom sheets provides a cold seal that recloses the package 10. The interior surface of the top sheet 12 temporarily adheres to the interior surface of the bottom sheet 14 to seal the package closed. As will be discussed in further detail below, reclosing the package 10 after opening isolates the interior 20 of the package 10 from its environment, which helps maintain the freshness of the buns B. In certain embodiments, gravity automatically recloses the package 10 after it has been opened. For example, under its own weight, the top sheet 12 presses against the bottom sheet 14 to form a cold seal. As can be seen, the illustrated package 10 is "passively reclosable" in that that the material that forms the walls of the package has innate sealing properties that enable reclosing of the package. No additional closure structure or action by a person is necessarily required to seal the package 10 after it has been opened. However, the best results are achieved when a person presses the top sheet 12 down against the bottom sheet 14.

After the package 10 is initially opened, it can be selectively reopened by pulling apart the top and bottom film sheets 12, 14 and then reclosed by pressing the interior surfaces into contact. The package 10 can be repeatedly reopened and reclosed as needed until the buns B are consumed. It will be understood that even if a second opening (not shown) is formed in the package, it will also have the ability to be sealingly closed and reopened.

Although the illustrated embodiment uses top and bottom film sheets 12, 14 that each have inner and outer layers 30, 32 of different materials to form the resealable package 10, that arrangement is not narrowly critical. For example, film sheets comprising other numbers of layers (i.e., one or more than two layers) may also be used as explained in further detail below. In other embodiments, the film sheets can be constructed differently to achieve a tacky interior surface without departing from the scope of the invention. Moreover, in other embodiments, only one of the top and bottom sheets will have a tacky interior surface without departing from the scope of the invention. Preferably, however, the top and bottom sheets of the package will have non-tacky exterior surfaces to facilitate machine-manufacture of the package.

In general, each of the layers 30, 32 comprises a polymer film, and the inner layer comprises a polymer film with a tack agent additive to provide tackiness. As will be explained in further detail below, the polymer of the inner layer 30 is configured to distribute the tack agent across the interior surface of the respective sheet 12, 14 to provide tackiness to the interior surface, while the polymer of the outer layer 32 is configured to limit migration of the tack agent through the outer layer so that the exterior surface of the respective sheet is substantially non tacky.

In one or more embodiments, the tack agent used in the inner layer 30 is polyisobutylene (PIB), but other embodiments can include other tack agents without departing from the scope of the invention. A suitable PIB may have a molecular weight of from about 100 g/mol to about 5,000 g/mol, such as from about 300 g/mol to about 2,500 g/mol. As explained below, the inner layer 30 is formed from the tack agent (e.g., PIB) and another polymer, such as a polyethylene (PE). Suitably, the amount of tack agent used in the inner layer 30 may be substantially greater than that of tack agents used in conventional cling films, such as stretch wrap films. For example, the tack agent can form from about 12% to about 50% of the inner layer 30 by weight, such as from about 15% to about 45% of the inner layer by weight or from about 18% to about 40% of the inner layer by weight. It is understood that these weight percentages may be calculated based on the raw tack agent stock that is used to form the inner layer 30 of the film, which in the case of PIB may be a solid concentrate including a PIB component and another component. For example, in one embodiment, a PIB concentrate comprising pellets of about 60% PIB by weight and about 40% linear low density polyethylene (LLDPE) by weight may be used as the raw tack agent stock. When such concentrates are used for the raw tack agent stock, the weight percentage of the tack agent can be measured as the ratio of the weight of the concentrate (i.e., the weight of the pellets, inclusive of both the PIB component and LLDPE component) to the weight of all raw materials used to form the inner layer 30 of the film (e.g., weight the raw tack agent stock, plus the weight of other materials used to form the tacky inner layer such as, for example, solid PE resins).

In one or more embodiments, at least one of, and preferably each of, the inner and outer layers 30, 32 of each sheet comprises polyethylene. For example, either or both of the inner and outer layers 30, 32 can comprise one or more PE selected from the group of PEs consisting of a high density polyethylene (HDPE), a low density polyethylene (LDPE), and a linear low density polyethylene (LLDPE).

The density of polyethylene used to form each layer 30, 32 is related to the migration of tack agent through the layer. All other things being equal, a higher density PE tends to inhibit migration of tack agent through a layer more than a lower density PE. Thus, to promote migration of the tack agent through the inner layer 30 to the interior surface of the respective sheet 12, 14 polyethylene having a relatively low density may be used to form the layer. For example, in one or more embodiments polyethylene used to form the inner layer 30 has a density of at less than about 0.925, such as less than about 0.920 g/cm$^3$. In contrast, to limit migration of the tack agent through the outer layer 32 and ensure the exterior surface of the respective sheet 12, 14 remains substantially non-tacky, polyethylene having a relatively high density may be used to form the layer. For example, in one or more embodiments polyethylene used to form the outer layer 32 has a density of at least about 0.925 g/cm$^3$, such as at least about 0.935 g/cm$^3$, or at least about 0.945 g/cm$^3$. It is understood that a layer can comprise polyethylene having another density or comprise another type of polymer without departing from the scope of the invention.

In addition to allowing migration of the tack agent to the interior surface of the respective film sheet 12, 14, polyethylene used to form the inner layer 30 should also have properties that limit the tackiness of the interior surface so that the buns B may be removed from direct contact with the tacky interior surface in a non-destructive manner (i.e., without damaging the buns due to adhesion with the interior surface). In one embodiment, the level of tackiness of the interior surface can be limited by the density of polyethylene that is used to form the inner layer 30. For example, in one or more embodiments, the density of polyethylene that forms the inner layer is at least about 0.88 g/cm$^3$, such as at least about 0.90 g/cm$^3$, or at least about 0.905 g/cm$^3$. Thus, it can be seen that the inner layer may be formed of polyethylene having a density in a range of from about 0.88 g/cm$^3$ to about 0.925 g/cm$^3$ to promote migration of the tack agent to the interior surface, while ensuring the tackiness does not create adhesion with the buns B that would damage the buns when they are removed.

Certain exemplary films will now be briefly described. In one embodiment, the inner tacky layer 30 comprises a PIB concentrate and a C-4 linear low density polyethylene (LLDPE); for example, about 30% PIB concentrate by weight and about 70% C-4 LLDPE by weight. In another embodiment, the tacky layer 30 comprises metallocene-LLDPE. The non-tacky outer layer 32 of each of the film sheets 12, 14 can, in some embodiments, be a mixture of polymers. For example, in one preferred embodiment, the non-tacky outer layer 14 comprises a mixture of a high density polyethylene (HDPE), a C-4 LLDPE, and a low density polyethylene (LDPE); for example about 75% HDPE by weight, about 15% C-4 LLDPE by weight, and about 10% LDPE by weight.

Certain surface treatments may be used to enhance the sealing characteristics of the interior surfaces of the top and bottom film sheets 12, 14. In suitable embodiments, the tacky inner layers 30 are corona treated to enhance the cold sealing properties of the interior surfaces of the top and bottom film sheets 12, 14. As one skilled in the art will appreciate, corona treatment of the film increases the surface energy of the film so that the film sheets 12, 14 may be inherently attracted to one another for self-closing. In some embodiments, the interior surface of one or both of the film sheets 12, 14 is textured to enhance the sealing engagement between the film sheets when the package is closed. Examples of suitable surface textures are disclosed in U.S. Pat. Nos. 5,662,758 and 6,489,022.

As explained below, the film sheets 12, 14 may be cut from rolled film. The film may be rolled so that the inner and outer layers 30, 32 alternate radially and such that the tacky inner layer is in direct contact with the outer layer of another segment of the film. The film is suitably configured to inhibit adhesion (sometimes called "blocking") between the tacky inner layer and the non-tacky outer layer that it directly contacts. In one or more embodiments, the outer layer 32 may comprise an anti-adhesion ("anti-blocking") agent such as, for example, silica, diatomaceous earth, etc.

Each of the top and bottom film sheets 12, 14 has about the same thickness T1. In a preferred embodiment, each of the top and bottom film sheets 12, 14 has a total thickness T1 of about 12 microns. The inner tacky layer 30 of each sheet 12, 14 has a thickness T2, and the outer layer 32 has a thickness T3. In one or more embodiments, the thickness T2 of the inner tacky layer 30 is from about 5% to about 50% of the sheet thickness T1, for example, from about 10% to about 45% or about 20% to about 40% of the sheet thickness. The thickness T3 of the outer layer may be from about 40% to about 95% of the sheet thickness T1, such as from about 50% to about 95% or about 60% to about 80% of the sheet thickness. In certain embodiments, the tacky inner layer 30 of each of the top and bottom sheets 12, 14 is about 20% of the total thickness T1 of the respective sheet and the non-tacky outer layer 32 is about 80% of the total thickness of the respective sheet. Other thicknesses can be used for the tacky and non-tacky layers of the film without departing from the scope of the invention.

Figure 3:
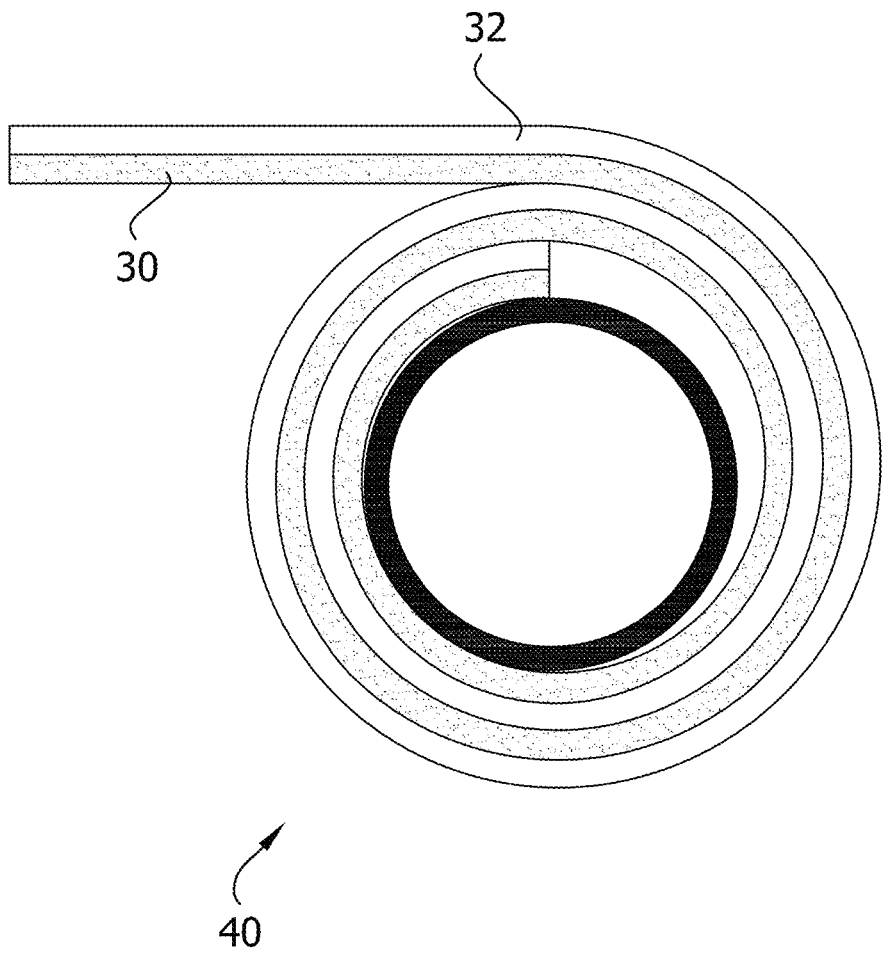
FIG. 3 is a side elevation of a roll of film used to form the package.

A method of manufacturing the film package 10 will be briefly discussed before discussing the use of the package. Referring to FIG. 3, in one or more preferred embodiments, the top and bottom film sheets 12, 14 are formed from rolls 40 of blown film. The manufacturer of the film extrudes tubes of film that include a tacky layer 30 and a non-tacky layer 32. The manufacturer cuts the blown tube along a longitudinal axis to form a planar sheet of film, which it subsequently winds onto a roll 40. As shown in FIG. 3, the film is wound onto the roll so that a first segment extends circumferentially around the core of the roll, a second segment extends circumferentially around the first segment, a third segment extends circumferentially around the second segment, etc. The tacky layers 30 of adjacent film segments do not oppose and engage one another. Instead, the non-tacky layer 32 of one segment of film separates the tacky layer 30 of that segment from the tacky layer of the adjacent segment. Thus, the non-tacky layer 32 and the tacky layer 30 alternate radially of the film roll 40, with the non-tacky layer separating adjacent segments of the tacky layer. This prevents the tacky layers 30 of adjacent film segments from adhering together while wound onto the roll and improves the machine handling characteristics of the film for forming the film into the package 10. In the illustrated embodiment, there is no intermediate material, such as a peelable divider, disposed between the tacky layer 30 of one segment and the non-tacky layer 32 of the layer that is in contact therewith. As explained above, the film is configured to prevent blocking, so the tacky layer 30 does not adhere to the non-tacky layer 32. However, use of a divider would not depart from the scope of the present invention.

Figure 4:
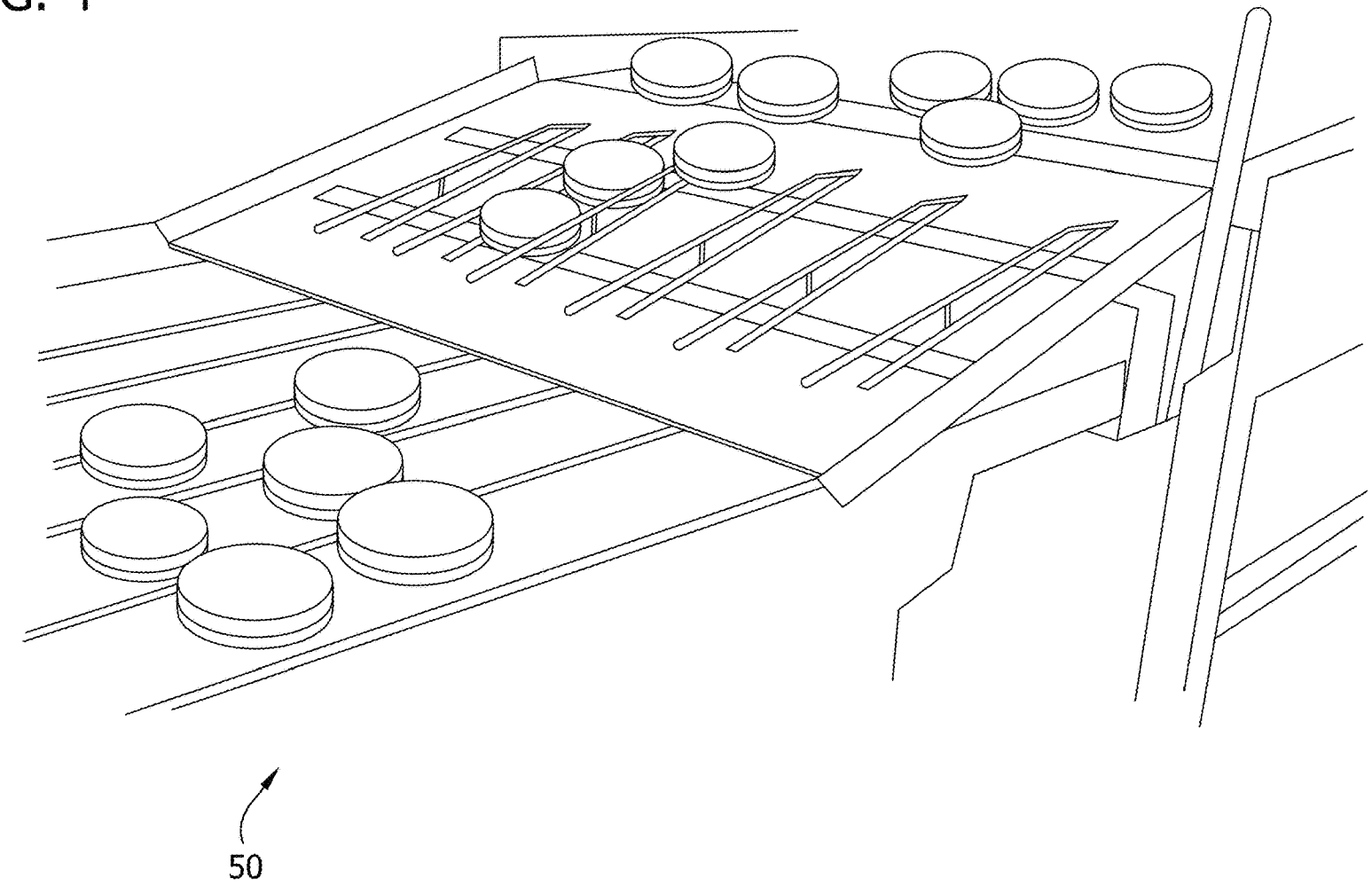
FIG. 4 is a perspective of an infeed subsystem of a packaging system.
Figure 5:
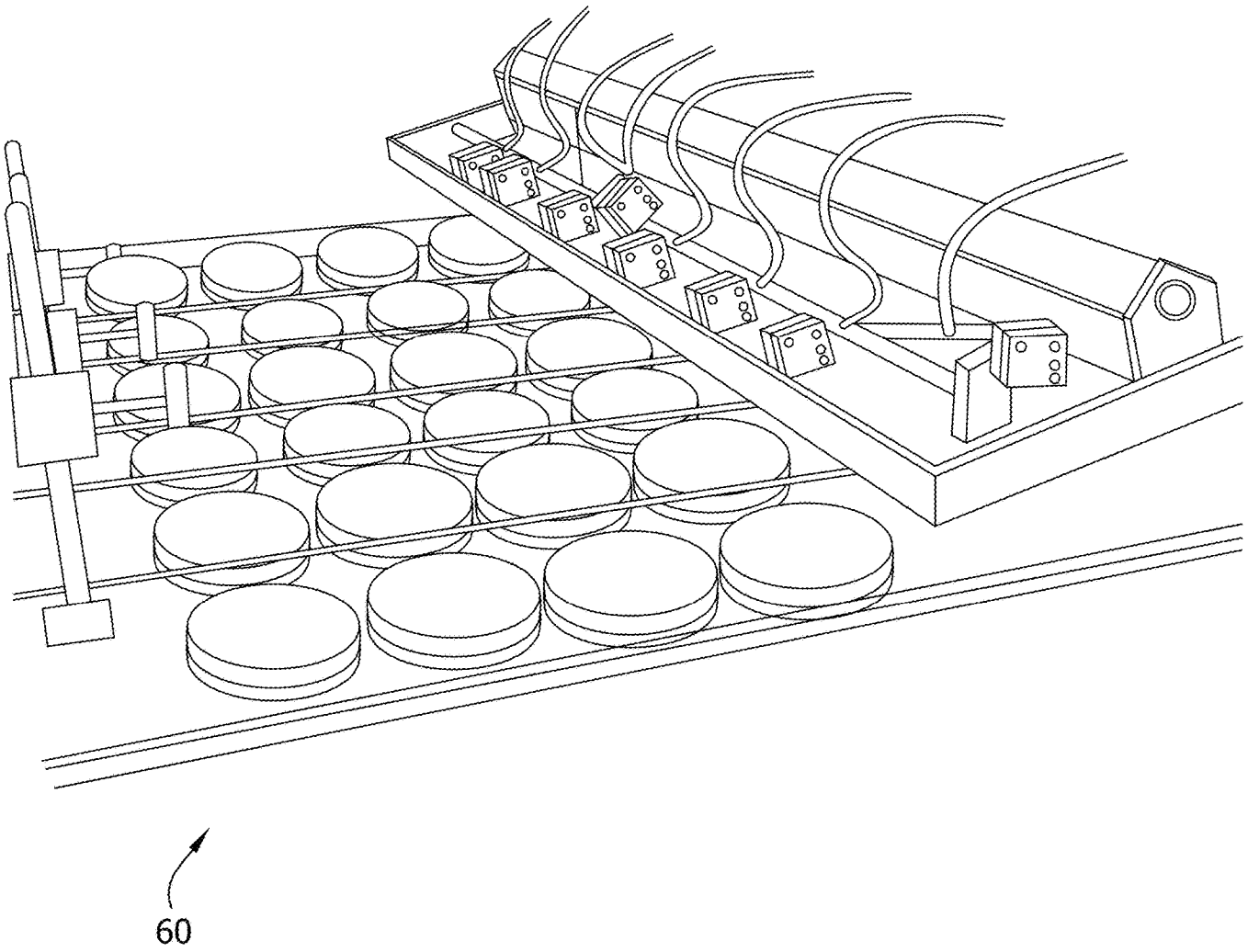
FIG. 5 is a perspective of an indexing subsystem of the packaging system.
Figure 6:
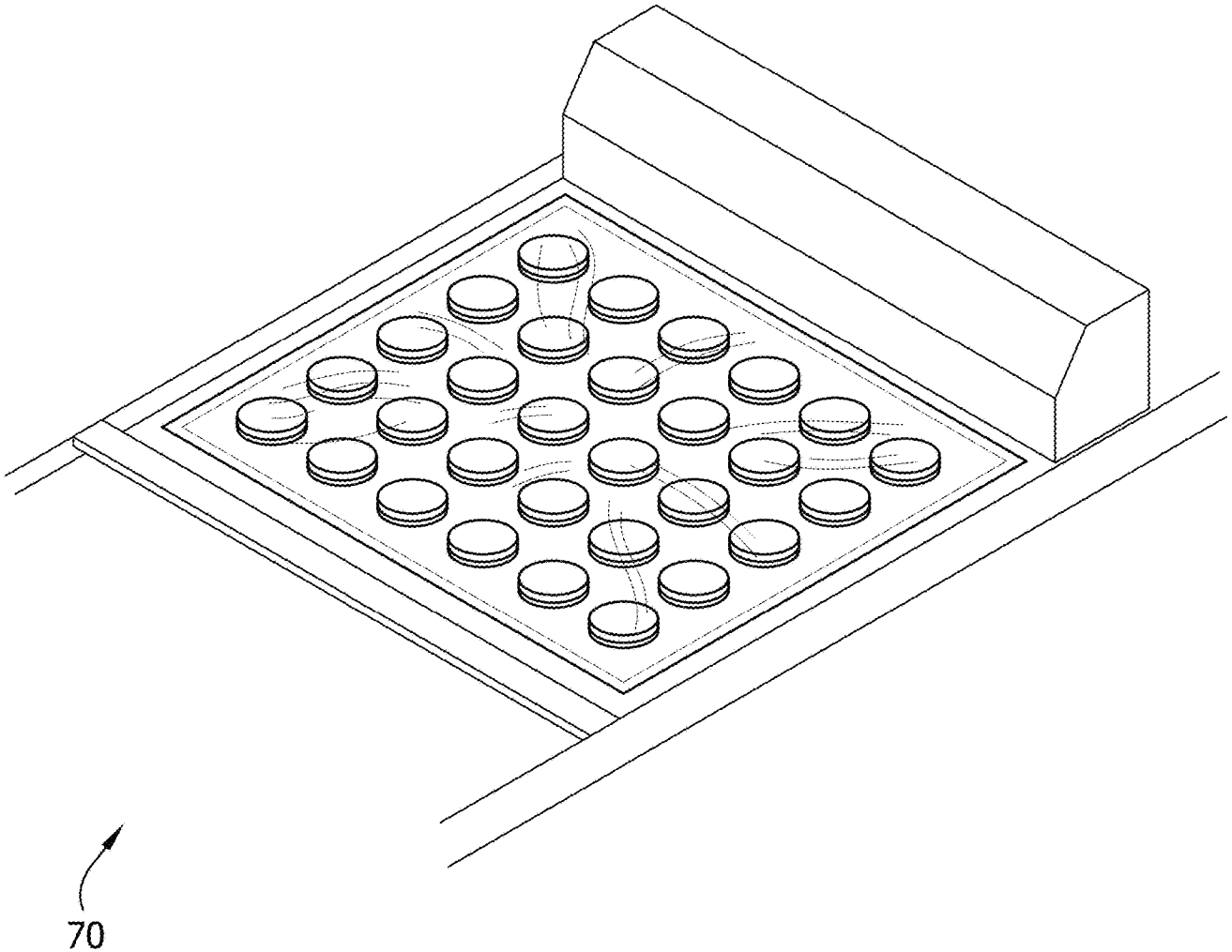
FIG. 6 is a perspective of a sealing subsystem of the packaging system.

In a preferred embodiment, a packager installs two film rolls 40 in an automated packaging system, which uses the film from the rolls to form the packages 10. Any suitable packaging system may be used without departing from the scope of the invention. For example, U.S. Pat. Nos. 3,355,857 and 3,490,353 describe certain suitable packaging systems. In addition, FIGS. 4-6 illustrate three subsystems of an exemplary packaging system. The packaging system illustrated in FIGS. 4-6 includes an infeed system 50 (FIG. 4) that receives bulk quantities of buns B and organizes them into rows. The infeed system 50 sends the rows of buns B to an indexing system 60 (FIG. 5), which groups together the desired number of buns for a package 10 and positions the buns for being received in the package. A sealing system 70 (FIG. 6) uses the film from two film rolls 40 to enclose the buns B it receives from the indexing system 60 in a package 10.

More specifically, the sealing system 70 is configured to position the buns between top and bottom film sheets 12, 14 from the rolls 40 and to seal the perimeter edge margins 16 of the film sheets to form the package 10. Preferably, the sealing system 70 orients the film from the two film rolls 40 so that the tacky layer 30 of each of the top and bottom sheets 12, 14 faces inward toward the buns B. The sealing system 70 unwinds the film from the lower film roll 40 so that the tacky layer 30 faces upward and the non-tacky layer 32 faces downward and unwinds the film from the upper film roll so that the tacky layer faces downward and the non-tacky layer faces upward. Before completely sealing the perimeter edge margins 16 to enclose the buns B, the sealing system 70 positions the buns B atop the lower film sheet 14 and positions the upper film sheet 12 atop the buns. In the illustrated embodiment, the buns B are positioned atop the lower film sheet 14 in direct contact with the tacky interior surface of the inner layer 30. In one embodiment, the sealing system 70 seals the leading edge margins of the upper and lower film sheets 12, 14 together and forces the buns B against the sealed leading edge to draw out film from the two film rolls 40. Once all the buns B in the package 10 are received between the film sheets 12, 14, the sealing system 70 seals together the side and trailing edge margins of the film to form the package 10 and separate (e.g., cut) the package from the rolls 40. In the illustrated embodiment, the sealing system 70 is configured to form a package 10 defining a single chamber in the package interior 20 for receiving perishable goods. The sealing system 70 can also be configured to form a seal between the sheets 12 and 14 that extends along another line oriented parallel to the side edges of the package 10 and extending between the front and trailing edges, to divide the interior of the package 10 into two separate chambers. Sealing system 70 can be further configured to form a seal along another line extending parallel to the front and rear edges that extends between the opposite side edges to form four separate chambers within the package interior. Either before or after the forming the package 10, the manufacturer can form a zone of weakness defining a tear line 22 on one or both of the top and bottom film sheets 12, 14. The manufacturer can also mark the film with an indication of the location of the tear line.

In a preferred embodiment, certain conditions of the packaging environment are controlled. For example, in one or more embodiments, the buns B are packaged at a temperature of from about 100° F. to about 110° F. In certain preferred embodiments, the buns B are packaged in an environment having a relative humidity of about 80%. Preferably, the environment in which the buns B are packaged has a water activity of about 0.90. Although these exemplary environmental packaging conditions are believed to enhance the freshness of the packaged buns B, the buns can also be packaged in other environmental conditions without departing from the scope of the invention.

After the sealing system 70 encloses the buns B in the packages 10, the packages are preferably placed on trays (not shown), which are stored in a refrigerated environment prior to use. For example, in one or more embodiments, each package 10 is positioned on a tray, which is positioned on a rack of trays in a refrigerated distribution center. When the buns B are needed in a restaurant, the packages 10 are delivered on the trays to the restaurant where they are put into service.

At the restaurant, a user can open a package 10 to access the buns B by tearing the film sheet 12 along the tear line 22. With the package open, the user can remove some of the buns B by disengaging them from the interior surfaces of the inner layers 30 and withdrawing them from the interior 20 of the package 10. The tackiness properties of the inner layers 30 are such that the buns 30 are separated from the interior surfaces without damaging the buns. After removing some of the buns B from the package 10, the package can be closed by pressing the interior surfaces of the top and bottom film sheets 12, 14 into contact. This engages the tacky layer 30 of the top sheet 12 against the tacky layer of the bottom sheet 14, which seals closed the package 10 by temporarily adhering the top film sheet to the bottom film sheet using the tackiness of the inner layers. The act of pressing the top sheet 12 into contact with the bottom sheet 14 can be performed easily and quickly by a restaurant worker. The top sheet 12 can also be configured to automatically fall under its own weight into contact with the bottom sheet 14 to reseal the package 10. If, after resealing the package 10, more buns B are needed, the restaurant worker can reopen the package by pulling the top and bottom sheets 12, 14 apart. When buns are no longer needed, the package 10 can again be sealed closed by pressing the interior surface of the top sheet 12 against the interior surface of the bottom sheet 14. The restaurant worker can repeat the steps of reopening and reclosing the package 10 until all the buns B are removed from the package.

In certain embodiments, the packages 10 are opened and closed in an environment that is not conducive to maintaining freshness. For example, in one or more embodiments, packages 10 are opened and closed in an environment having a temperature of from about 75° F. to about 78° F. and a relative humidity of about 60%. Generally, by reclosing the package 10 after each time buns B are removed, the buns have at least two-times (e.g., about 2.5-times, about 3.0-times, about 4.0-times, about 6.0-times, about 8.0-times) the shelf life after opening of buns stored in conventional, non-reclosable packaging.

Figure 7:
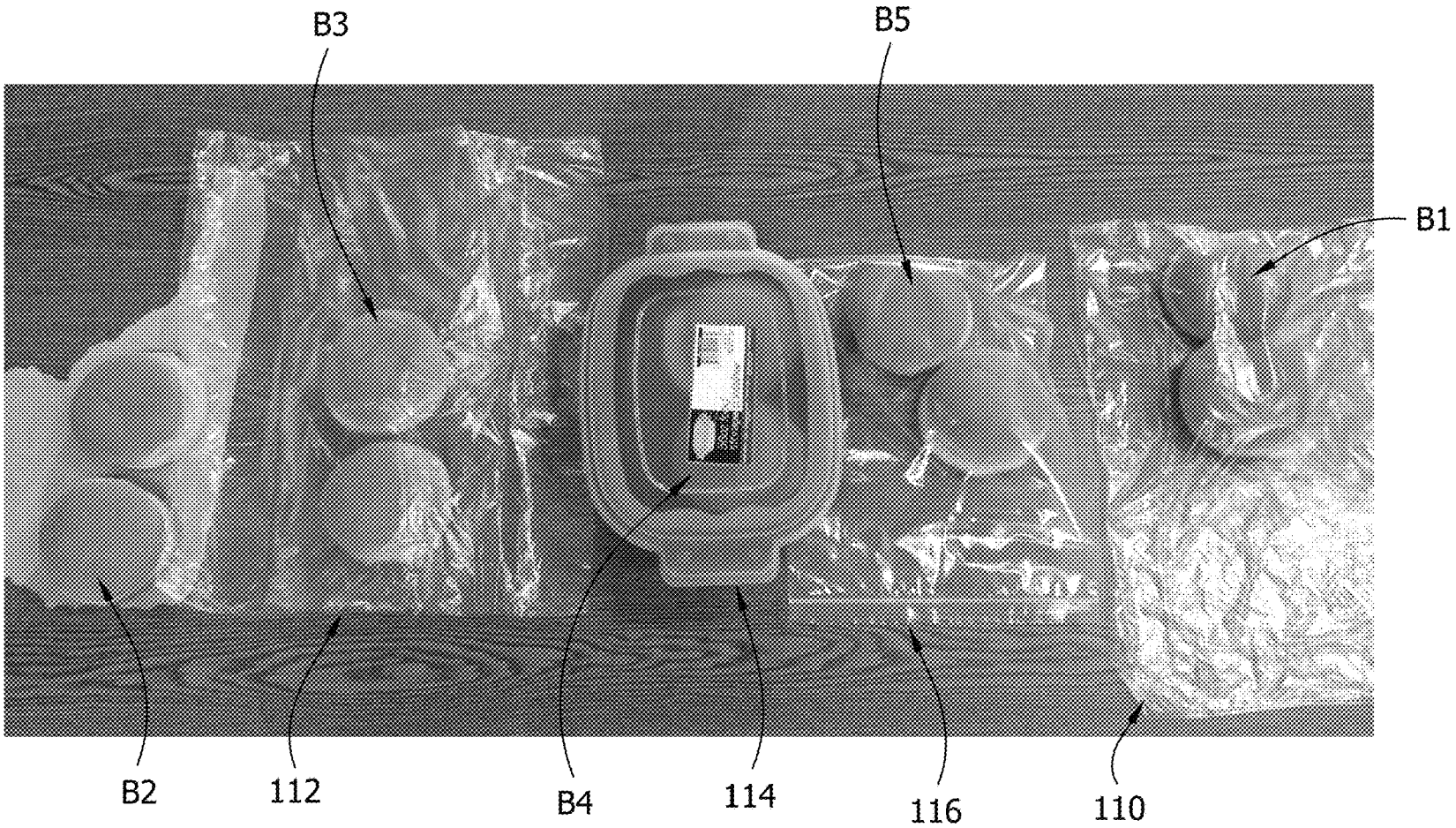
FIG. 7 is a photograph of test specimens in a moisture loss test.

The effectiveness of reclosable, tacky film packaging at maintaining the freshness of buns was tested against other types of containers. The testing procedures and results will now be briefly described. Referring to FIG. 7, the shelf life of buns B1 stored in a package 110, which is similar to package 10 in that it is formed of tacky reclosable film, was tested against other buns. Buns B2 were stored unenclosed in environmental conditions; buns B3 were stored in a conventional, non-reclosable package 112; buns B4 were stored in a reusable lidded enclosure 114; and buns B5 were stored in a zippered bag 116. The test measured the moisture loss in the buns B1, B2, B3, B4, B5 at certain time intervals.

At an initial time, the buns B1, B2, B3, B4, B5 were weighed. After the initial weighing, the buns B1, B3, B4, B5 were placed in their respective packages 110, 112, 114, 116 and the buns B2 were placed in the ambient environment. Three and one-half hours after the initial weighing, the buns B1, B2, B3, B4, B5 were removed, reweighed, and returned to their packages 110, 112, 114, 116. This procedure was repeated at 5 hours, 8 hours, and 72 hours after the initial weight measurement. Table 1 recites the weight loss percentages of the buns B1, B2, B3, B4, B5 at each time interval. The weight loss figures presented in Table 1 are thought to be proportional to the moisture loss in the buns B1, B2, B3, B4, B5.

TABLE 1

| Buns | B1 | B2 | B3 | B4 | B5 |
|---|---|---|---|---|---|
| Package | 110 | N/A | 112 | 114 | 116 |
| 3.5 hr | 0.11% | 3.25% | 0.13% | 0.11% | 0.04% |
| 5 hr | 0.15% | 4.56% | 0.20% | 0.22% | 0.06% |
| 8 hr | 0.23% | 6.07% | 0.71% | 0.32% | 0.12% |
| 72 hr | 1.29% | 20.96% | 7.78% | 1.61% | 0.27% |

As shown in Table 1, the tacky film package 110 performed better at preventing moisture loss than all of the packages except for the zippered bag 116. As compared with the buns B3 in the conventional, non-reclosable film package 112, the buns B1 in the tacky, reclosable package 110 had weight loss improvements of 18% at 3.5 hours, 33% at 5 hours, 209% at 8 hours, and 503% at 72 hours. Thus, the tacky, reclosable package 110 is thought to preserve the shelf life of buns much longer after opening than the conventional, non-reclosable package 112. Moreover, moisture loss in buns generally begins at the exterior portion of the bun and moves gradually toward the interior. Thus, the improved weight loss performance of the package 110 would be readily observable by customers who are served the buns B1. As compared with the buns B3, the buns B1 are more saleable because the exterior appears moister.

Figure 8:
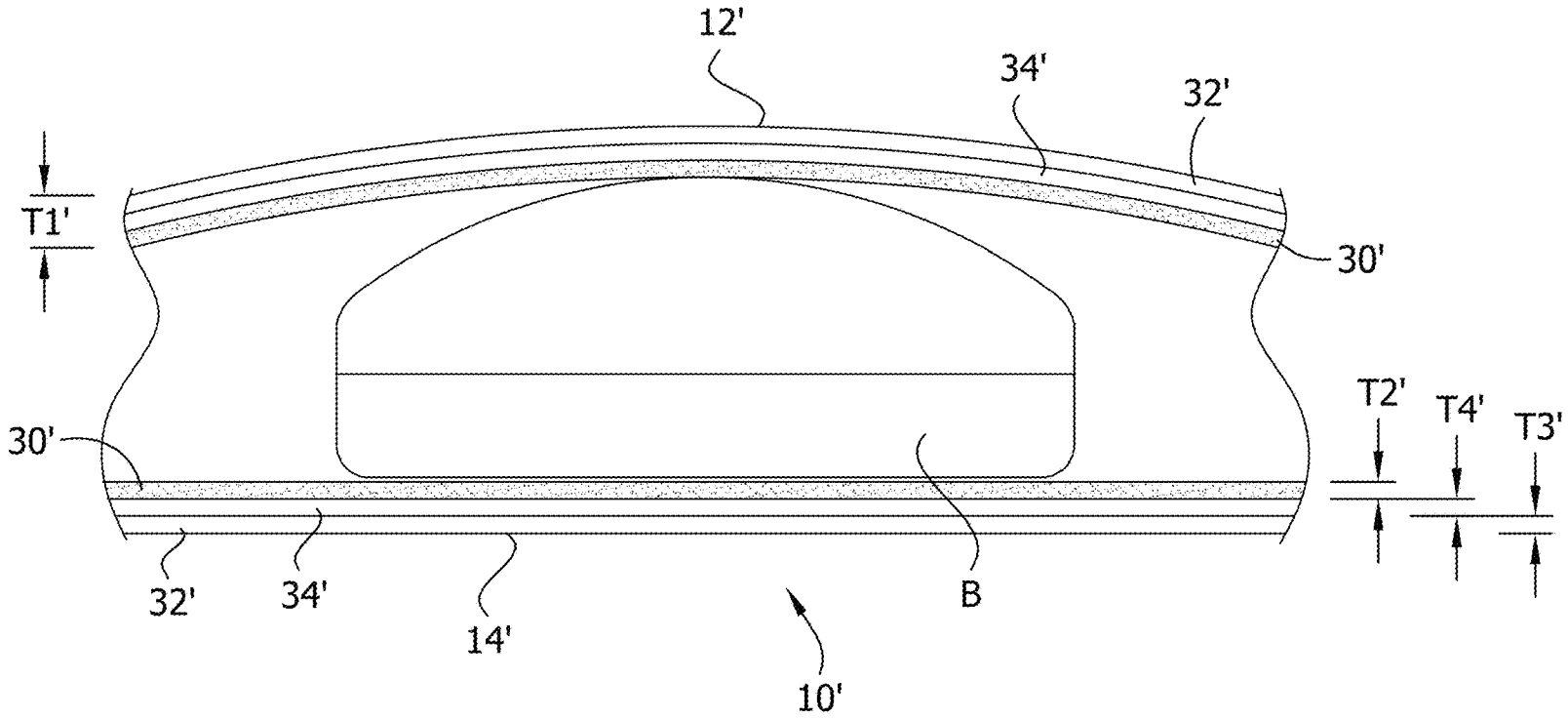
FIG. 8 is a fragmentary cross section similar to FIG. 2 of another embodiment of a package of hamburger buns B.

Referring to FIG. 8, another package for receiving buns B or other perishable goods is generally indicated at 10'. The package 10' is similar in many respects to the package 10 described above, and like features are given like reference numbers, plus a prime symbol. Like the package 10, the package 10' comprises a top sheet 12' and a bottom sheet 14'. The top sheet 12' and the bottom sheet 14' are each formed of a substantially identical, multilayer film comprising an inner tacky layer 30' and an outer non-tacky layer 32'. The inner tacky layer 30' may have the same properties as the inner tacky layer 30 described above, and the outer non-tacky layer 32' may have the same properties as the outer non-tacky layer 32 described above. Unlike the top and bottom sheets 12, 14, the top and bottom sheets 12', 14' also include a core layer 34' disposed between the inner layer 30' and the outer layer 32'.

In one or more embodiments, the core layer 34' comprises a HDPE and at least one of a LDPE and a LLDPE. For example, the core layer 34' can be formed of from about 60% to about 90% HDPE by weight and from about 10% to about 40% by weight of LDPE, LLDPE, or a combination thereof. Using a core layer 34' of this composition enhances heat sealing of the peripheral edges of the top and bottom sheets 12', 14' such that seals can be formed at lower temperatures and have improved strength.

Each of the top and bottom film sheets 12', 14' has about the same thickness T1'. The inner tacky layer 30' of each sheet 12', 14' has a thickness T2', the outer layer 32' has a thickness T3', and the core layer 34' has a thickness T4'. In one or more embodiments, the thickness T2' of the inner tacky layer 30' is from about 5% to about 50% of the sheet thickness T1', the thickness T3' of the outer layer 32' is from about 5% to about 50% of the sheet thickness T1', and the thickness T4' of the core layer 34' is from about 20% to about 80% of the thickness T1'. Other thicknesses can be used for the layers 30', 32', 34' of the sheets 12', 14' without departing from the scope of the invention.

One exemplary embodiment of film that was used in a bun packaging machine to form a package 10' will now be described in detail. The exemplary film has an inner tacky layer 30' that comprises a PIB concentrate and LLDPE having a density of about 0.918 g/cm$^3$, and PIB concentrate and LLDPE each form about 50% of the inner tacky layer by weight. The outer layer 32' of the film comprises HDPE having a density of about 0.946 g/cm$^3$. The core layer 34' comprises HDPE having a density of about 0.946 g/cm$^3$, LLDPE having a density of about 0.918 g/cm$^3$, and LDPE having a density of about 0.923 g/cm$^3$. The core layer comprises about 75% of the HDPE by weight, about 15% of the LLDPE by weight, and about 10% of the LDPE by weight. In the exemplary film, the thickness T2' of the inner tacky layer 30' makes up about 40% of the total thickness T1' and the thicknesses T3', T4' of the outer layer 32' and the core layer 34' each make up about 30% of the total thickness T1'. Table 2 below shows the properties of this exemplary film as tested according to the ASTM testing methodology listed in the table.

TABLE 2

| Properties | Unit | Test Method | Results |
|---|---|---|---|
| Gauge | micron | ASTM E252 | 12.61 |
| Tensile Strength, MD | psi | ASTM D882 | 6676 (46.03 MPa) |
| Tensile Strength, TD | psi | ASTM D882 | 2709 (18.68 MPa) |
| Tensile Elongation, MD | % | ASTM D882 | 294 |
| Tensile Elongation, TD | % | ASTM D882 | 350 |
| Gloss | % | A5TMD2457 | 55.6 |
| Haze | % | ASTM D1003 | 12.2 |

As can be seen, the illustrated packages 10, 10', 110 provide a reclosable enclosure for maintaining the freshness of perishable goods such as hamburger buns. The packages 10, 10', 110 provide cold resealing capabilities at a low manufacturing cost using film with a single tacky surface. The film can be processed by normal packaging equipment, and the tack surface has tackiness properties optimized for providing a temporary adhesive seal with another segment of film while limiting adhesion with perishable goods so that they can be separated from direct contact with the tacky side of the film without sustaining damage. Thus, the illustrated packages 10 provide a low cost, reclosable enclosure for storing perishable goods and preserving freshness.

OTHER STATEMENTS OF THE INVENTION

A. A method of packaging perishable goods comprising:

providing first and second film sheets having respective interior and exterior surfaces and perimeter edge margins, at least the first sheet having an inner layer defining the interior surface of the first sheet and comprising a tack agent, at least some of the tack agent migrating to the interior surface of the first sheet to provide tackiness to the interior surface of the first sheet;

positioning the perishable goods atop the first sheet in direct contact with the tacky interior surface;

using tackiness properties of the first sheet to limit adhesion between the first sheet and the perishable goods after said step of positioning the perishable goods;

positioning the second sheet atop the perishable goods; and sealing the perimeter edge margins of the first and second sheets together to form a package having an interior defined by the interior surfaces of the first and second sheets that encloses the perishable goods within the interior and that is selectively openable and reclosable by temporarily adhering the interior surface of the first sheet to the interior surface of the second sheet using the tackiness of said interior surface of the first sheet.

B. A method as set forth in statement A wherein the first and second sheets have any one or more features of the first and second sheets of claims 1 through 15 set forth hereinafter.

C. A method as set forth in either of statements A and B wherein the perishable goods are positioned atop the first film sheet at an environmental temperature of from about 100° F. to about 110° F.

D. A method as set forth in any of statements A through C wherein the perishable goods are positioned atop the first film sheet at an environmental relative humidity of about 80%.

E. A method as set forth in any of statements A through D wherein the perishable goods are positioned atop of the first film sheet at an environmental water activity of about 0.90.

F. A method as set forth in any of statements A through E wherein the step of providing the first and second film sheets comprises providing at least one film roll and separating the first and second film sheets from the at least one film roll.

G. A method as set forth in statement F wherein the at least one film roll comprises film having a tacky layer and a non-tacky layer, the film being wound onto the at least one film roll such that the non-tacky layer and tacky layer alternate radially of the at least one film roll.

H. A method as set forth in statement G wherein the non-tacky layer directly contacts the adjacent tacky layer as the film extends circumferentially about the roll.

I. A method as set forth in any of statements A through H wherein the step of using the tackiness properties of the first sheet to limit adhesion is performed until the perishable goods are removed from the package.

J. A method of packaging perishable goods comprising:

providing first and second film sheets having respective interior and exterior surfaces and perimeter edge margins, at least the first sheet having an inner layer including the interior surface of the first sheet and comprising a first polyethylene and a tack agent and an outer layer including the exterior surface of the first sheet and comprising a second polyethylene, the first polyethylene being configured to permit migration of the tack agent to the interior surface of the inner layer to provide tackiness to the interior surface of the first sheet and the second polyethylene being configured to block migration of the tack agent through the outer layer to the exterior surface such that the exterior surface is substantially non-tacky;

positioning the perishable goods atop the first sheet;

positioning the second sheet atop the perishable goods; and sealing the perimeter edge margins of the first and second sheets together to form a package having an interior defined by the interior surfaces of the first and second sheets that encloses the perishable goods within the interior and that is selectively openable and reclosable by temporarily adhering the interior surface of the first sheet to the interior surface of the second sheet using the tackiness of said interior surface of the first sheet.

K. A method as set forth in statement J wherein the first and second sheets have any one or more features of the first and second sheets of claims 15 through 22 set forth hereinafter.

L. A method as set forth in either of statements J and K further comprising any one or more of the features of statements A through I.

M. A method of using perishable goods comprising:

providing an opening in a package enclosing the perishable goods, the package comprising first and second film sheets having respective interior and exterior surfaces and perimeter edge margins, the first and second sheets being sealed together along the perimeter edge margins such that the interior surfaces of the sheets define an interior of the package receiving the perishable goods, at least the first sheet having an inner layer defining the interior surface of the first sheet and comprising a tack agent, at least some of the tack agent migrating to the interior surface of the first sheet to provide tackiness to the interior surface of the first sheet;

non-destructively removing a first portion of the perishable goods from the package by disengaging the first portion of the perishable goods from the interior surface of the first sheet and withdrawing the first portion of the goods through the opening, a second portion of the perishable goods remaining in the interior of the package after said step of removing the first portion;

closing the package after said step of removing the first portion of the perishable goods by pressing the interior surfaces of the and second film sheets into contact, thereby sealingly enclosing the second portion of perishable goods inside the package by temporarily adhering the first sheet to the second sheet using the tackiness of the interior surface of the first sheet to close the opening.

N. A method as set forth in statement M wherein the first and second sheets have any one or more features of the first and second sheets of claims 1 through 14 set forth hereinafter.

O. A method as set forth in either of statements M or N further comprising reopening the package by pulling the first and second film sheets apart after said step of closing the package.

P. A method as set forth in statement O further comprising reclosing the package after reopening the package by again pressing the interior surfaces of the first and second film sheets into contact.

Q. A method as set forth in any of statements M through P wherein the steps of tearing open the package and closing the package are performed in an environment having a temperature of from about 75° F. to about 78° F. and a relative humidity of about 60%.

R. A method as set forth in any of statements M through Q further comprising positioning a plurality of packages of perishable goods in a rack, each of the plurality of packages having the features of said package set forth in either of statements M or N.

S. A method of using perishable goods comprising:

providing an opening in a package enclosing the perishable goods, the package comprising first and second film sheets having respective interior and exterior surfaces and perimeter edge margins, the first and second sheets being sealed together along the perimeter edge margins such that the interior surfaces of the sheets define an interior of the package receiving the perishable goods, at least the first sheet having an inner layer that includes the interior surface of the first sheet and comprises a first polyethylene and a tack agent and an outer layer that includes the exterior surface of the first sheet and comprises a second polyethylene, the first polyethylene being configured to permit migration of the tack agent to the interior surface of the inner layer to provide tackiness to the interior surface of the first sheet and the second polyethylene being configured to block migration of the tack agent through the outer layer to the exterior surface such that the exterior surface is substantially non-tacky;

removing a first portion of the perishable goods from the package, a second portion of the perishable goods remaining in the interior of the package after said step of removing the first portion;

closing the package after said step of removing the first portion of the perishable goods by pressing the interior surfaces of the first and second sheets into contact, thereby sealingly enclosing the second portion of perishable goods inside the package by temporarily adhering the first sheet to the second sheet using the tackiness of the interior surface of the first sheet to close the opening.

T. A method as set forth in statement S wherein the first and second sheets have any one or more features of the first and second sheets of claims 15 through 22.

U. A method as set forth in either of statements S or T further comprising any one or more of the features of statements M through R.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A package for storing perishable goods comprising first and second film sheets having respective interior and exterior surfaces and perimeter edge margins, the first and second sheets being sealed together along the perimeter edge margins such that a portion of the interior surface of the first sheet and a portion of the interior surface of the second sheet define an interior of the package for receiving the perishable goods, the package being selectively openable by forming an opening in at least one of the first and second sheets and at least the first sheet having an inner layer defining the interior surface of the first sheet and comprising a polyethylene and a tack agent, at least some of the tack agent having migrated through the polyethylene to the interior surface of the first sheet along substantially an entirety of the portion of the interior surface of the first sheet defining the interior of the package to provide tackiness to the portion of the interior surface of the first sheet configured to temporarily adhere to the first sheet to the second sheet to reseal the package when the portion of the interior surface of the first sheet is pressed against the portion of interior surface of the second sheet after the package has been opened and the tackiness being configured to limit adhesion between the interior surface of the first sheet and said perishable goods such that the perishable goods in direct contact with the interior surface of the first sheet can be non-destructively separated therefrom and withdrawn from the package when the package is open.

2. A package as set forth in claim 1 wherein the polyethylene has a density in a range of from about 0.88 g/cm$^3$ to about 0.925 g/cm$^3$.

3. A package as set forth in claim 2 wherein the density of the polyethylene is at least about 0.90 g/cm$^3$.

4. A package as set forth in claim 2 wherein the density of the polyethylene is at least about 0.905 g/cm$^3$.

5. A package as set forth in claim 4 wherein the density of the polyethylene is less than about 0.920 g/cm$^3$.

6. A package as set forth in claim 1 wherein the tack agent forms from about 12% to about 50% of the inner layer by weight.

7. A package as set forth in claim 6 wherein the tack agent forms from about 15% to about 45% of the inner layer by weight.

8. A package as set forth in claim 7 wherein the tack agent forms from about 18% to about 40% of the inner layer by weight.

9. A package as set forth in claim 6 wherein the tack agent comprises a polyisobutylene.

10. A package as set forth in claim 1 wherein the polyethylene comprises at least one of a high density polyethylene, a low density polyethylene, and a linear low density polyethylene.

11. A package as set forth in claim 1 wherein the first sheet further comprises an outer layer defining the exterior surface of the first sheet.

12. A package as set forth in claim 11 wherein the outer layer comprises a polyethylene, the polyethylene of the outer layer being configured to block migration of the tack agent to the exterior surface.

13. A package as set forth in claim 11 wherein the first sheet further comprises a core layer comprising a high density polyethylene and at least one of a low density polyethylene and a linear low density polyethylene.

14. A package as set forth in claim 11 wherein the second sheet has an inner layer defining the interior surface of the second sheet and comprising a polyethylene and a tack agent providing tackiness to the interior surface of the second sheet.

15. A package as set forth in claim 1 wherein the second sheet comprises substantially the same materials as the first sheet.

16. A package as set forth in claim 1 wherein the first sheet comprises blown film.

17. A package as set forth in claim 1 wherein the tack agent comprises a PIB concentrate forming from about 18% to about 40% of the inner layer by weight.

18. A package as set forth in claim 1, wherein the first sheet has a thickness less than about 50 microns.

19. A package for storing perishable goods comprising first and second film sheets having respective interior and exterior surfaces and perimeter edge margins, the first and second sheets being sealed together along the perimeter edge margins such that a portion of the interior surface of the and a portion of the interior surface of the second sheet define an interior of the package for receiving the perishable goods, the package being selectively openable by forming an opening in the first and second sheets and at least the first sheet having an inner layer defining the interior surface of the first sheet and comprising a first polyethylene and a tack agent and an outer layer defining the exterior surface of the first sheet and comprising a second polyethylene, the first polyethylene being configured to permit migration of the tack agent to the interior surface of the first sheet along substantially an entirety of the portion of the interior surface of the first sheet defining the interior of the package to provide tackiness to the portion of the interior surface of the first sheet configured to temporarily adhere the first sheet to the second sheet to reseal the package when the portion of the interior surface of the first sheet is pressed against the interior surface of the second sheet after the package has been opened, the second polyethylene being configured to block migration of the tack agent through the outer layer to the exterior surface of the first sheet such that the exterior surface of the first sheet is substantially non-tacky.

20. A package as set forth in claim 19 wherein the second polyethylene has a density of at least about 0.925 g/cm$^3$.

21. A package as set forth in claim 20 wherein the density of the second polyethylene is at least about 0.935 g/cm$^3$.

22. A package as set forth in claim 21 wherein the density of the second polyethylene is at least about 0.945 g/cm$^3$.

23. A package as set forth in claim 19 wherein the outer layer further comprises an anti-blocking agent.

24. A package as set forth in claim 19 wherein the first polyethylene has a density in a range of from about 0.88 g/cm$^3$ to about 0.925 g/cm$_3$.

25. A package as set forth in claim 19 wherein the tack agent is a polyisobutylene.

* * * * *